US009209535B2

(12) United States Patent
Correa et al.

(10) Patent No.: US 9,209,535 B2
(45) Date of Patent: Dec. 8, 2015

(54) DEVICE FOR SECURING A CELL BATTERY WITH IMPROVED CONTACT

(71) Applicant: ETA SA Manufacture Horlogere Suisse, Grenchen (CH)

(72) Inventors: David Correa, Bienne (CH); Stephane Rychen, Bern (CH); Roger Willemin, Grenchen (CH); Jonathan Collaud, Givisiez (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 94 days.

(21) Appl. No.: 14/073,100

(22) Filed: Nov. 6, 2013

(65) Prior Publication Data

US 2014/0127952 A1 May 8, 2014

(30) Foreign Application Priority Data

Nov. 8, 2012 (EP) ..... 12191821

(51) Int. Cl.

| | |
|---|---|
| ***H01R 3/00*** | (2006.01) |
| ***H01R 11/22*** | (2006.01) |
| ***G04G 17/04*** | (2006.01) |
| ***G04G 17/06*** | (2006.01) |
| ***G04C 3/00*** | (2006.01) |

(52) U.S. Cl.

CPC ..... *H01R 11/22* (2013.01); *G04C 3/008* (2013.01); *G04G 17/04* (2013.01); *G04G 17/06* (2013.01)

(58) Field of Classification Search

CPC .. H01R 11/22; H01R 13/2442; H01R 13/245; H01R 13/2457; G04C 3/008; G04G 17/04; G04G 17/06

USPC ..... 439/500

See application file for complete search history.

(56) References Cited

U.S. PATENT DOCUMENTS

| | | | |
|---|---|---|---|
| 2,907,810 | A | 10/1959 | Detwiler et al. |
| 2,985,704 | A | 5/1961 | Kempf et al. |
| 2,985,705 | A | 5/1961 | Smythe |
| 4,478,524 | A | 10/1984 | Saitoh et al. |

FOREIGN PATENT DOCUMENTS

| | | | |
|---|---|---|---|
| GB | 2 075 223 | A | 11/1981 |
| GB | 2 112 562 | A | 7/1983 |
| JP | 11-281776 | | 10/1999 |

OTHER PUBLICATIONS

European Search Report issued Mar. 15, 2013, in European Application No. 12 19 1821 filed Nov. 8, 2012 (with English Translation).

*Primary Examiner* — Khiem Nguyen

(74) *Attorney, Agent, or Firm* — Oblon, McClelland, Maier & Neustadt, L.L.P.

(57) ABSTRACT

The present invent concerns a portable object comprising at least a middle part and a back cover for confining an electronic module, said electronic module including a plate provided with a housing arranged for receiving an electrical energy accumulator, said electronic module including at least one circuit with at least one electrical contact area, and a connecting contact member for providing an electrical connection between said accumulator and said at least one contact area, said contact member being elastically deformable.

17 Claims, 2 Drawing Sheets

DEVICE FOR SECURING A CELL BATTERY WITH IMPROVED CONTACT

This application claims priority from European Patent application No.12191821.3 filed Nov. 8, 2012, the entire disclosure of which is incorporated by reference.

FIELD OF THE INVENTION

The invention concerns a portable object comprising at least a middle part and a back cover for confining an electronic module, said electronic module including a plate provided with a housing arranged for receiving an electrical energy accumulator, said electronic module further including at least one circuit with at least one electrical contact area, and a connecting contact member for providing an electrical connection between said accumulator and said at least one contact area, wherein said connecting contact member is elastically deformable.

The invention also concerns a timepiece comprising at least one structure of this type.

The invention concerns the field of horology, and in particular the field of watches comprising at least one electronic or electrical circuit powered by an accumulator such as a cell battery or similar. The invention more specifically concerns the mechanical and electrical connection between an accumulator and a circuit, on both sides of a bottom plate.

BACKGROUND OF THE INVENTION

The quality of the electrical contacts in a watch must be permanently ensured, in every configuration of use, and particularly during acceleration or a shock. More particularly, a permanent electrical power supply from an accumulator, generally a cell battery, requires a very good connection between the poles of the accumulator and the utilisation circuit or circuits. It is known, in particular, to secure a cell battery in a housing formed by spring tongues, which hold the cell battery while ensuring contact across one of the terminals thereof. The contact at the other terminal is commonly achieved via a flexible connector, or preferably, via a lug forming a spring, secured by screws or rivets to a plate.

As regards the utilisation circuits, contacts are known which are formed by welded flexible connectors, plug-in bars, or by spring lugs pressed onto the circuit, also by screws, rivets or similar, or forming small jumpers clamping the circuit over the thickness of the edge thereof.

To achieve a high quality permanent contact, with the smallest number of components, there is also known, for example from JP Patent No. 11-281 776 in the name of MIYOTA, a spring comprising two arms, one of which is supported on a circuit and the other of which is supported on a cell battery, with the latter being held in place by the back cover of a watch.

However, the arms are supported in the same direction, and the spring lug is not guaranteed to be permanently supported on the circuit. Thus, when there is a shock or sudden movement, the spring lug may no longer be supported. This arrangement also requires a mechanical connection dedicated to the assembly of the circuit on a plate carrying the cell battery.

SUMMARY OF THE INVENTION

It is therefore an object of the invention to overcome the drawbacks of the prior art by proposing to provide a portable object provided with an element forming an electrical connection between the electrical accumulator and the electronic circuit mounted on a plate providing a permanent electrical connection and which also enables a large accumulator to be held in said plate.

The invention therefore concerns a portable object comprising at least a middle part and a back cover for confining an electronic module, said electronic module including a plate provided with a housing arranged for receiving an electrical energy accumulator, said electronic module further including at least one circuit with at least one electrical contact area, and a connecting contact member for providing an electrical connection between said accumulator and said at least one contact area, wherein said connecting contact member is elastically deformable, characterized in that said connecting contact member is formed of a shaped strip including a central portion, at the ends of which there extend at least one first and one second converging arms arranged to clamp said electronic module and thereby hold said electrical energy accumulator in its housing.

One advantage of the present invention is that it provides a portable object wherein the battery is properly held in the plate.

In a first advantageous embodiment, said at least one first and one second arms converge in the same plane.

In a second advantageous embodiment, the central part is flat, said flat part being in contact with said electrical energy accumulator when the back cover is secured to the middle part.

In a third advantageous embodiment, the central part includes at least one tip arranged to be in contact with said electrical energy accumulator, the back cover secured to the middle part exerting a force on said electronic module via the at least one tip of said connecting contact member.

In another advantageous embodiment, the central part is deformed so as to include at least one projecting portion forming said at least one tip.

In another advantageous embodiment, the central part includes at least one protuberance extending from said central part and forming said at least one tip.

In another advantageous embodiment, the central part includes two tips.

In another advantageous embodiment, each arm includes a loose end which is bent so as to diverge.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

The invention concerns the field of horology, and in particular the field of watches comprising at least one electronic or electrical circuit powered by an accumulator such as a cell battery or similar. The invention more specifically concerns the mechanical and electrical connection between an accumulator and a circuit, on both sides of a bottom plate. In particular, in a watch this means guaranteeing the contact between the positive terminal of the cell battery and the back cover of the case in all circumstances.

Figure 1:
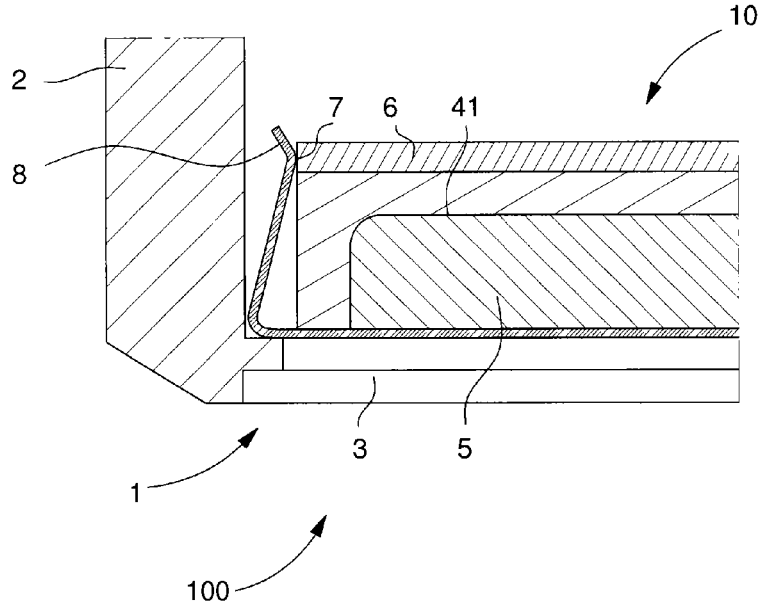
FIG. 1 is a schematic cross-section of a portable electronic apparatus according to the invention.

The invention, shown in FIG. 1, concerns a structure 1 of a timepiece 100, particularly a watch, comprising at least a middle part 2 and a back cover 3 for confining an electronic or electrical module 10. This electronic module 10 sends data to a display module.

Figure 6:
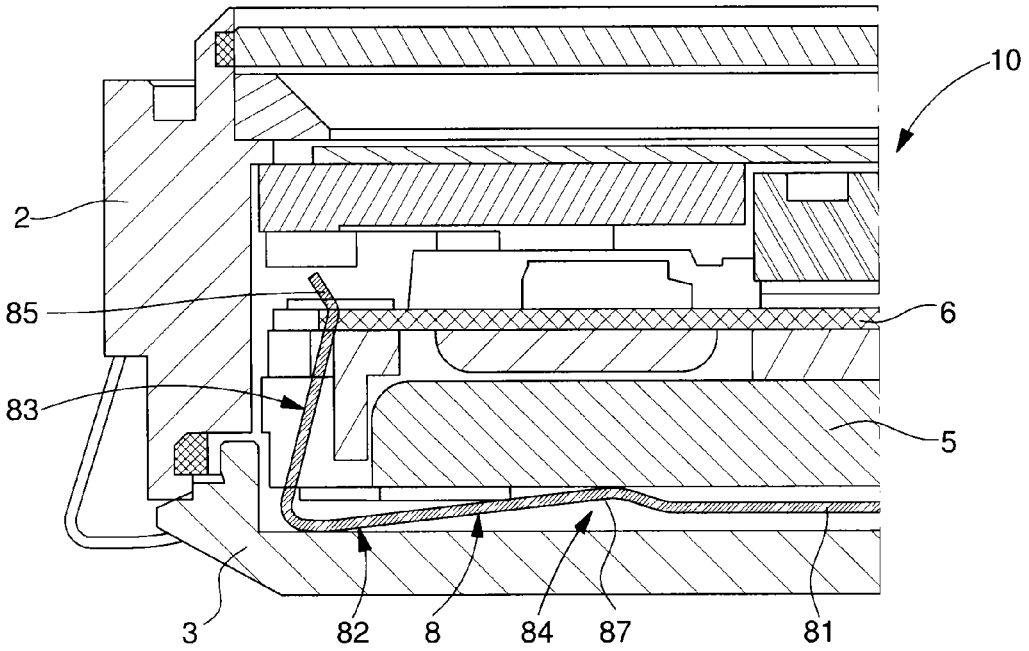
FIG. 6 is a schematic cross-section of a preferred version of the electronic apparatus according to the invention.

This module 10 in turn includes a plate 4 having a compartment or housing 41 which is arranged to receive an electrical energy accumulator 5, particularly a cell battery. Plate 4 may be arranged so that compartment 41, in which the electrical energy accumulator is placed, occupies almost the entire surface of plate 4. For example, it is possible to envisage compartment 41 of plate 4 occupying the entire surface of the plate, with the exception of a peripheral portion 42 defining said compartment 41 as seen in FIG. 6. This allows the portable object to operate using a larger electrical energy accumulator which is thus potentially more powerful or has a longer lifetime. This module 10 also includes at least one circuit 6 with at least one electrical contact area 7 and a connecting contact member 8 for forming an electrical connection between an accumulator 5 and a contact area 7. This connecting contact member 8 is elastically deformable so that, when subjected to a deforming stress, the elastic capacity of the contact member tends to return it to a rest geometry. In a preferred but non-limiting version of the invention, connecting contact member 8 is entirely elastic and is made in the form of a spring.

According to the invention, the connecting contact member takes the form of a shaped strip 8. This shaped strip 8 includes a central rectilinear portion 81 having a flat profile as seen in FIG. 1. At each end 82 of central flat portion 81 there extends at least one arm 83. It is clear that shaped strip 8 includes at least a first arm 83 and at least a second arm 83.

If shaped strip 8 includes a first arm 83 and a second arm 83, said shaped strip 8 is arranged so that said first arm 83 and said second arm 83 extend in the same plane. It is clear that first arm 83 and second arm 83 extend in the plane perpendicular to the plane of central portion 81.

Figure 5:
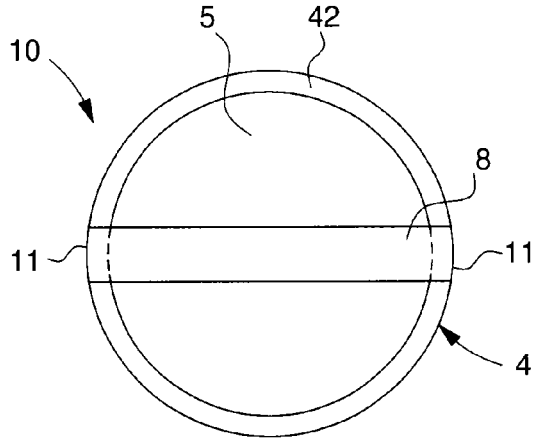
FIG. 5 shows a schematic bottom view of the electronic apparatus according to the invention; and shows a schematic cross-section of a preferred version of the electronic apparatus according to the invention.

Advantageously, first arm 83 and second arm 83 extend so as to converge. This configuration of arms 83 provides a shaped strip 8 having a natural clamp function. Indeed, when electrical energy accumulator 5 is mounted in the plate, said accumulator 5 is first of all placed in its compartment. Then, the connecting contact member is secured to said electronic module 10. To achieve this, electronic module 10 has two notches 11 arranged on the external face of module 10. These notches are made to be diametrically opposite, as seen in FIG. 5.

Thus, when connecting contact member 8 is secured, first arm 83 and second arm 83 are moved apart and inserted into the notches provided. The stress exerted on the arms is then released so that first and second arms 83 tend to return to their rest position, thereby clamping said module 10. Then, force simply needs to be exerted on the central portion of shaped strip 8 in order to slide and position the latter in its final position. This final position is characterized in that central portion 81 is in contact with electrical energy accumulator 5. Likewise, the first arm or the second arm are in contact with a contact area 7 of circuit 6. This contact area 7 takes the form of a metallisation which may be located on the edge of circuit 6. Consequently, electrical conduction is achieved between the electrical energy accumulator and circuit 6.

Advantageously, a contact area 7 is arranged on each notch so that each arm allows electrical conduction. Once connecting contact member 8 has been secured, electronic module 10 is placed in the case and the back cover is secured. The back cover 3 may be screwed or driven into or snapped onto the middle part. Preferably, electronic module 10 and back cover 3 are arranged so that said back cover 3 and connecting contact member 8 are in contact.

Figure 2:
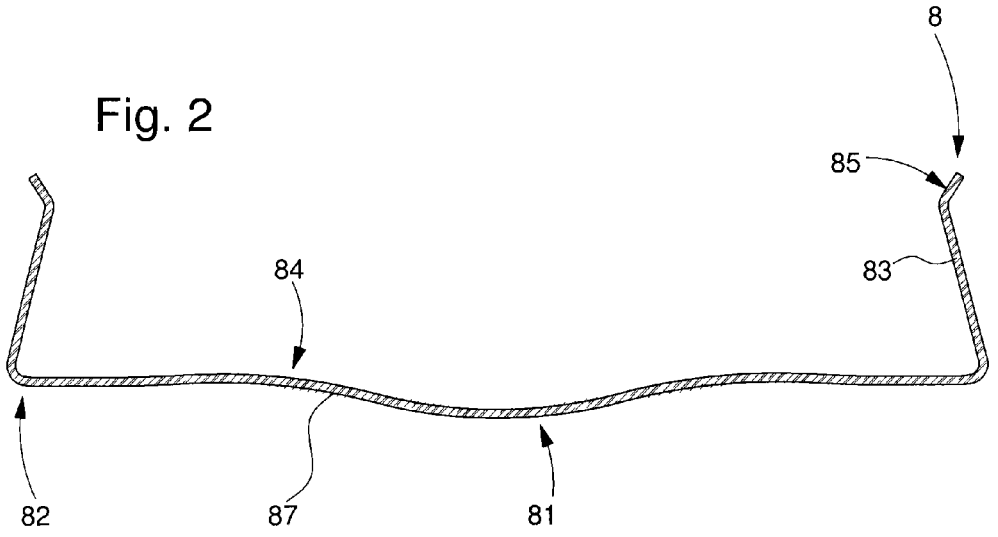
FIG. 2 is a schematic cross-section of the spring of the electronic apparatus according to the invention.

In a first variant seen in FIGS. 2 and 6, the profile of central portion 81 is not flat. More specifically, the profile of central portion 81 is provided with several tips 84, i.e. central portion 81 is in three dimensions. These tips 84 may be protuberances 86 arranged on central portion 81 and extending perpendicularly to the plane of the central portion. These tips 84 may be made by plastically deforming said central portion 81 so that the latter has a non-rectilinear profile, i.e. the profile includes projecting areas 87 preferably extending towards the cell battery. For example, the profile may be sinusoidal or triangular.

Advantageously, central portion 81 is arranged to have two tips 84. These tips 84 improve the electrical contact. This improvement in the electrical contact is due to the fact that the central portion is made in three dimensions. Indeed, in this variant, the central portion of shaped strip 8 is only in contact with electrical energy accumulator 5 via the tips 84 contained therein. The fact that the central portion is in three dimensions causes a force to appear when electronic module 10 is placed in case 1 and back cover 3 is secured. This force is exerted on connecting contact member 8 which transmits the force to electronic module 10. The force results from the fact that the volume necessary to cover the central portion in three dimensions is larger than if said central portion were flat. When the inner dimensions of the case do not change, a force appears.

This force first presses connecting contact member 8 onto electrical energy accumulator 5. Consequently, the electrical contact formed by said member 8 between circuit 6 and electrical energy accumulator 5 is efficient and is unlikely to be interrupted.

Secondly, this force immobilises electronic module 10 inside the case of the portable object. Indeed, the force exerted by back cover 3 on connecting contact member 8 is transmitted onto plate 4 which is then pressed onto the display module. Electronic module 10 is consequently fixedly held by the assembly formed of connecting contact member 8 and back cover 3.

In a second variant seen in FIG. 5, the loose ends 85 of each arm 83 are curved. Each loose end 85 is curved so to have an inverse curvature to the curvature of said arm 83. It is therefore clear that loose end 85 tends to diverge. This configuration of the loose ends 85 of arms 83 facilitates the assembly of said connecting contact member 8. Indeed, when connecting contact member 8 is secured to electronic module 10, the curved loose ends 85 will enter into contact with said module 10. The divergent curvature of said ends results in a space between said loose ends 85 and thus a space between said arms 83. The space enables connecting contact member 8 to be secured without the user having to move arms 83 apart himself. This operation automatically occurs when the user wishes to secure said connecting contact member 8.

Figure 3:
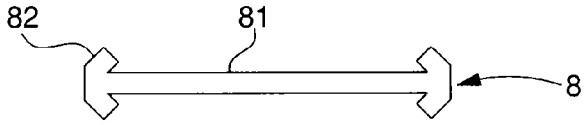
FIGS. 3 to 4 show schematic top views of variants of the spring of the electronic apparatus according to the invention.
Figure 4:
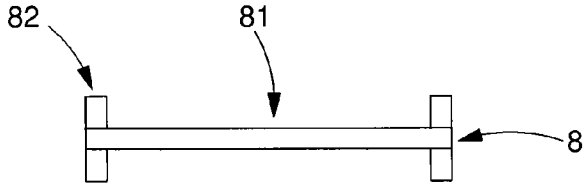

In a third variant shown in FIGS. 3 and 4, the connecting contact member 8 is arranged so that several arms 83 extend from each end 82 of central portion 81. Preferably, two arms 83 extend from each end 82 of central portion 81. In that case, electronic module 10 is arranged so that the notches located on the external face of module 10 are adapted accordingly.

The number of notches 11 could then be identical to the number of arms 83 or the size of the notches could allow there to be several arms 83 per notch 11.

In a first solution of this variant shown in FIG. 3, it is possible for arms 83 to extend so that, seen from above, each end of the central portion has a shape similar to a Y. In the present case, the various arms of the shaped strip all converge on a single point.

In a second solution shown in FIG. 4, it is possible for each end of central portion 81 to include a perpendicular portion so that, seen from above, each end of the central portion has a shape similar to a T. Arms 83 extend from the perpendicular portion, on both sides of the central portion. In the present case, the various arms of the shaped strip all converge on a single axis.

In another variant, it is possible for the electrical energy accumulator 5 not to occupy the entire surface of plate 4, with the compartment for said accumulator being sized accordingly. Said plate is then provided with orifices in which the notches for the connecting contact member are made, in proximity to said compartment.

It will be clear that various alterations and/or improvements and/or combinations evident to those skilled in the art may be made to the various embodiments of the invention set out above without departing from the scope of the invention defined by the annexed claims.

What is claimed is:

1. A portable object comprising at least a middle part and a back cover for confining an electronic module, said electronic module including a plate provided with a housing arranged for receiving an electrical energy accumulator, said electronic module including at least one circuit with at least one electrical contact area, and a connecting contact member for providing an electrical connection between said accumulator and said at least one contact area, said contact member being elastically deformable, wherein said connecting contact member is formed of a shaped strip including a central portion at the ends of which there extend at least one first and one second converging arms arranged to clamp said electronic module and thereby hold said electrical energy accumulator in the housing thereof.

2. The portable object according to claim 1, wherein said at least one first arm and one second arm converge in the same plane.

3. The portable object according to claim 1, wherein the central portion is flat, said flat portion being in contact with said electrical energy accumulator when the back cover is secured to the middle part of the object.

4. The portable object according to claim 2, wherein the central portion is flat, said flat portion being in contact with said electrical energy accumulator when the back cover is secured to the middle part of the object.

5. The portable object according to claim 1, wherein the central portion includes at least one tip arranged to be in contact with said electrical energy accumulator, the back cover secured to the middle part of the object exerting a force on said electronic module via at least one tip of said connecting contact member.

6. The portable object according to claim 2, wherein the central portion includes at least one tip arranged to be in contact with said electrical energy accumulator, the back cover secured to the middle part of the object exerting a force on said electronic module via at least one tip of said connecting contact member.

7. The portable object according to claim 5, wherein the central portion is deformed so as to include at least one projecting portion forming said at least one tip.

8. The portable object according to claim 6, wherein the central portion is deformed so as to include at least one projecting portion forming said at least one tip.

9. The portable object according to claim 5, wherein the central portion includes at least one protuberance extending from said central portion and forming said at least one tip.

10. The portable object according to claim 6, wherein the central portion includes at least one protuberance extending from said central portion and forming said at least one tip.

11. The portable object according to claim 5, wherein the central portion includes two tips.

12. The portable object according to claim 6, wherein the central portion includes two tips.

13. The portable object according to claim 7, wherein the central portion includes two tips.

14. The portable object according to claim 8, wherein the central portion includes two tips.

15. The portable object according to claim 9, wherein the central portion includes two tips.

16. The portable object according to claim 10, wherein the central portion includes two tips.

17. The portable object according to claim 1, wherein each arm has a loose end curved so as to diverge.

* * * * *